US005301843A

United States Patent [19]

Groene et al.

[11] Patent Number: 5,301,843

[45] Date of Patent: Apr. 12, 1994

[54] COMBINATION CAULKING TUBE CAP AND APPLICATOR DEVICE

[75] Inventors: David E. Groene, Centerville, Ohio; Earl E. Hoyt, Franklin Lakes, N.J.

[73] Assignee: DAP Products Inc., Tipp City, Ohio

[21] Appl. No.: 42,864

[22] Filed: Apr. 5, 1993

[51] Int. Cl.[5] ..... B67D 1/07

[52] U.S. Cl. ..... 222/192; 222/562; 401/139

[58] Field of Search ..... 222/192, 568, 570, 562; 30/136.5; 7/105, 158; 401/139, 126, 262; 15/236.07; 425/87; 215/228

[56] References Cited

U.S. PATENT DOCUMENTS

| | | | |
|---|---|---|---|
| D. 332,901 | 2/1993 | Campbell . | |
| 98,949 | 1/1870 | Gerelds . | |
| 936,695 | 10/1909 | Barth . | |
| 1,394,868 | 10/1921 | Smith . | |
| 2,060,415 | 11/1936 | Helgason | 7/105 X |
| 2,157,481 | 5/1939 | Cothern | 111/82 |
| 2,271,285 | 1/1942 | Bussert | 18/3.5 |
| 2,593,674 | 4/1952 | Harnsberger | 30/142 |
| 2,609,970 | 9/1952 | Blumson | 222/192 |
| 2,943,338 | 7/1960 | Lowen | 425/87 |
| 3,087,654 | 4/1963 | Moore | 222/105 |
| 3,133,300 | 5/1964 | Freeman | 15/236 |
| 3,192,555 | 7/1965 | Nyden | 222/192 X |
| 3,267,516 | 8/1966 | Eckhaus | 18/3.5 |
| 3,744,079 | 7/1973 | Krause | 15/235.7 |
| 3,761,992 | 10/1973 | Schneller | 15/210 |
| 3,846,060 | 11/1974 | Otis | 425/458 |
| 3,930,599 | 1/1976 | Brothers et al. | 222/143 |
| 3,963,357 | 6/1976 | Crisp | 401/191 |
| 4,211,501 | 7/1980 | Pedroso et al. | 401/261 |
| 4,213,546 | 7/1980 | Massey | 222/546 |
| 4,248,660 | 2/1981 | Johnson | 156/579 |
| 4,883,204 | 11/1989 | Kay et al. | 222/192 |
| 5,018,956 | 5/1991 | Lemaster | 425/87 |
| 5,099,783 | 3/1992 | Bourgeois | 118/213 |

FOREIGN PATENT DOCUMENTS

| | | | |
|---|---|---|---|
| 2921633 | 12/1980 | Fed. Rep. of Germany | 401/139 |
| 2548630 | 1/1985 | France . | |

*Primary Examiner*—Gregory L. Huson
*Attorney, Agent, or Firm*—Biebel & French

[57] ABSTRACT

A combination cap and applicator device is disclosed for capping a container of air curable material and for spreading the material dispensed from the container. The device includes a cap having a cylindrical inner sleeve for engaging a nozzle of the container to thereby form an interference friction fit for sealing the nozzle. In addition, the spreader blade includes a pair of laterally extending wing portions for defining a concave spreader surface. The spreader surface decreases in width in a direction extending away from the cap body to form a thin flexible edge which deflects to provide a wiping action as the spreader blade is used to form a bead of caulking material.

17 Claims, 3 Drawing Sheets

COMBINATION CAULKING TUBE CAP AND APPLICATOR DEVICE

BACKGROUND OF THE INVENTION

The present invention relates to a combination cap and applicator device and, more particularly, to a combination cap and applicator device for capping a container of air curable material and for spreading the material dispensed from the container.

Sealants such as caulking and other air curable materials are typically provided in a cartridge or squeezable tube. The cartridge or tube includes a slightly tapered nozzle extending from one end thereof wherein the end of the nozzle is typically formed as a sealed tip for isolating the material within the container from the atmosphere and thereby preventing hardening of the material. When application of the material such as caulking is desired, the sealed tip is simply cut off, leaving an opening through which the caulking may be dispensed. Often times, however, the contents of the caulking cartridge may not be entirely dispensed during a caulking operation, and if precautions are not taken to reseal or close the nozzle, the remaining caulking compound will harden due to exposure to the atmosphere. The same problem is also encountered when the nozzle of a cartridge or tube of glue or other hardenable and extrudable substance is opened and partially used. Thus, a closure device is required for the end of the open nozzle to prevent hardening of the extrudable substance.

Once the material has been dispensed from the cartridge or tube, it is typically spread to form a smooth bead, and this operation is typically performed using a finger, backside of a spoon, popsicle stick, or a separate tool which is specially designed for the operation. Since the special tool is generally not provided with the cartridge or tube, the do-it-yourselfer will typically not have such a tool available when performing a caulking operation and will resort to using a finger to spread out the caulking which can lead to non-professional appearing results.

SUMMARY OF THE INVENTION

A primary object of the present invention is to provide a combination cap and applicator device for placement on the end of a nozzle for a cartridge or other container containing caulking or other hardenable and extrudable material whereby an interference fit is formed between the device and the nozzle to prevent air flow into the cartridge, and to facilitate tooling of a caulking bead in a desired location by use of the applicator device.

In one aspect of the invention a combination cap and applicator device is provided comprising: a tubular cap body having opposing first and second ends, the cap body defining a longitudinal axis for the device, means interior of the cap body for engaging a container nozzle, and a spreader blade formed integrally with the cap body and extending from the second end of the cap body for spreading a material dispensed through the container nozzle.

The spreader blade preferably includes a concave spreader surface defined by laterally extending wing portions facing away from the longitudinal axis defined by the cap body. In addition, the spreader decreases in width and thickness in a direction extending away from the cap body to form a flexible feathered edge.

The cap body may be used as a handle to guide the spreader blade along a bead of caulking with the wing portions defining a channel on either side of the caulking to guide the caulking toward an apex at the flexible feathered edge where the caulking is then smoothed as the blade edge flexes and performs a wiping action on the caulking.

Other objects and advantages of the invention will be apparent from the following description, the accompanying drawings, and the appended claims.

DETAILED DESCRIPTION OF THE PREFERRED EMBODIMENT

Figure 1:
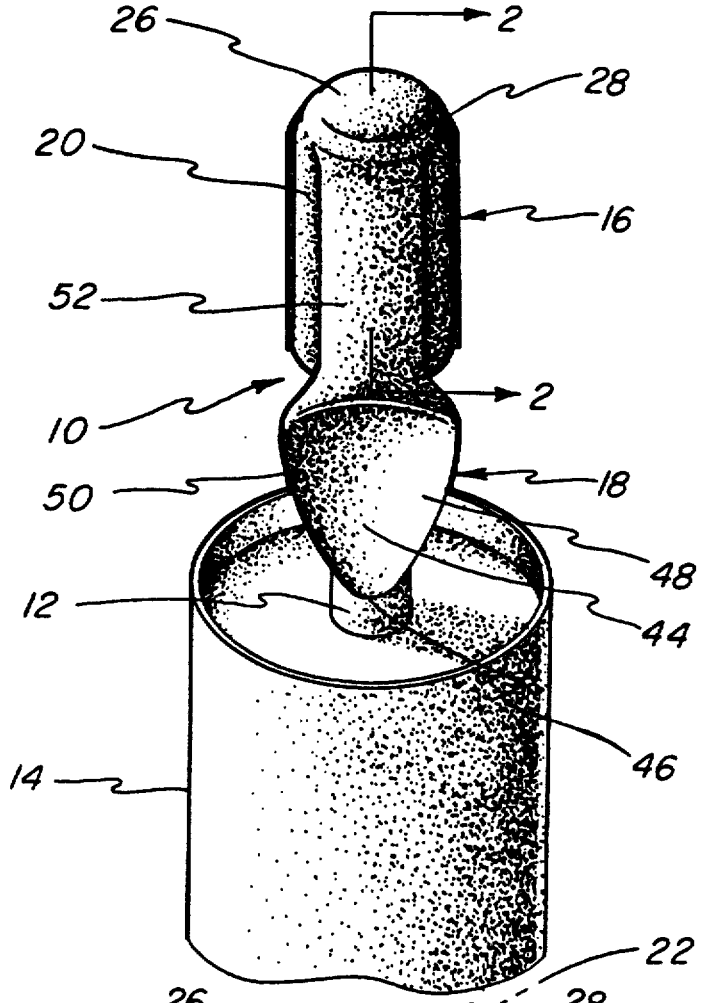
FIG. 1 is a perspective view of the cap and applicator device of the present invention mounted onto a caulking cartridge.

Referring to FIG. 1, the cap and applicator device 10 of the present invention is shown mounted to a tapered dispensing nozzle 12 of a caulking cartridge 14. It should be noted that although the present invention is shown and described with reference to a caulking cartridge, the device 10 is also intended to be used with other containers such as a squeeze tube containing a sealant or other extrudable material.

The cap and applicator device 10 includes a main cap body 16 and a spreader blade 18 formed integrally with each other of a molded material, such as plastic. The main cap body 16 has a substantially cylindrically shaped side wall 20 defining a longitudinal axis 22 for the device, as may be further seen in FIG. 3.

Figure 2:
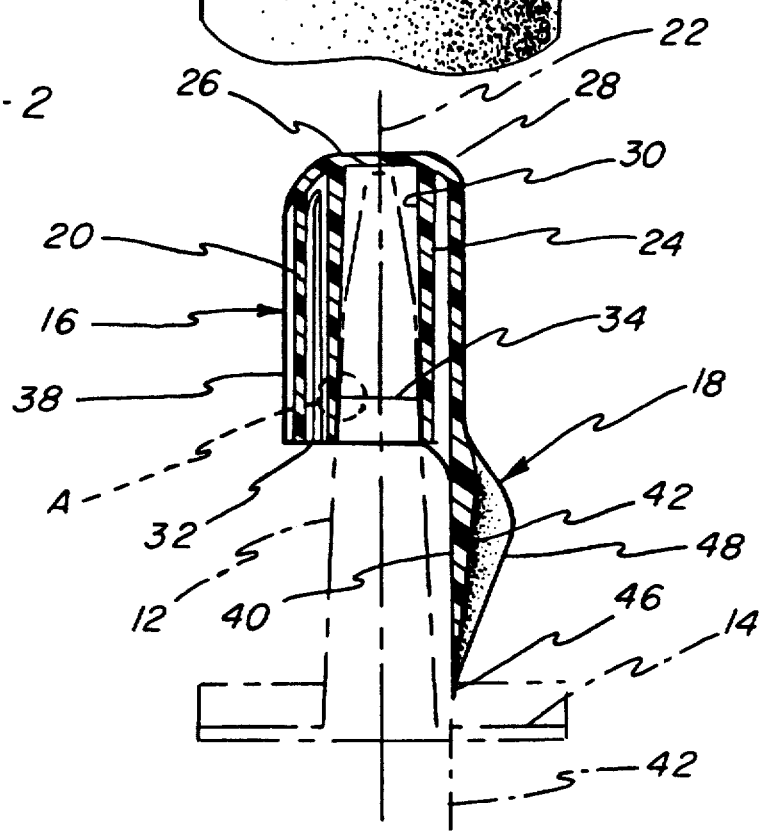
FIG. 2 is a cross-sectional side elevational view taken along line 2—2 in FIG. 1 and showing a cartridge nozzle in phantom lines.
Figure 3:
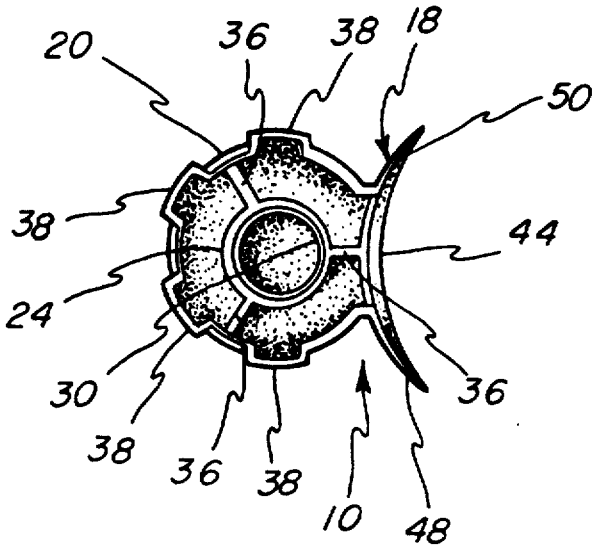
FIG. 3 is a bottom view of the present invention.
Figure 4:
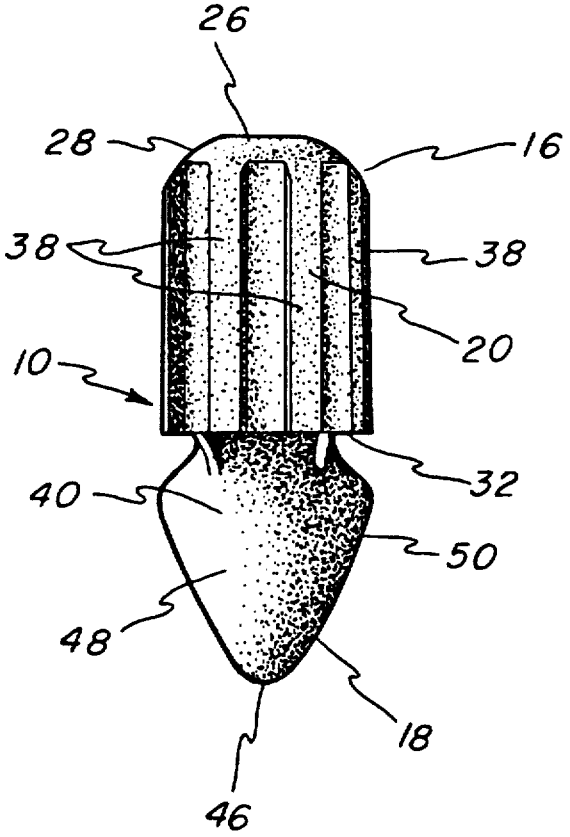
FIG. 4 is a side elevational view showing the back side of the spreader blade.

As seen in FIGS. 2 and 3, the cap body 16 includes a substantially cylindrical inner sleeve 24 extending from an end wall 26 forming a closure for a first end 28 of the cap body 16. The inner sleeve 24 is positioned in spaced relation to and substantially concentric with the cylindrical side wall 20. The inner sleeve 24 includes an inner wall 30 which is tapered slightly inwardly from a second end 32 of the cap body 16 toward the first end 28.

Figure 5:
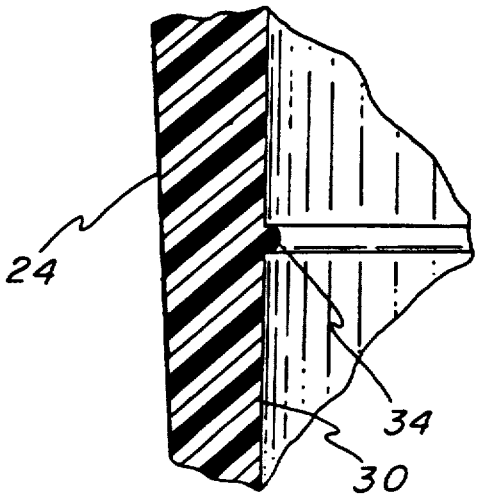
FIG. 5 is an enlarged view of detail A in FIG. 2.

The tapered inner wall 30 is adapted to contact the dispensing nozzle 12 of the container 14 in a tight interference friction fit to minimize air flow into the container. In addition, as may be seen in FIGS. 2 and 5, a bead 34 is formed on the inner surface 30 and extends radially inwardly for engaging the container nozzle 12 and defining a snap lock connection between the device 10 and the container nozzle.

It should be noted that the bead 34 forces a depression to be formed in the nozzle 12 such that the nozzle 12 need not be provided with a preformed depression in order to obtain the above-described locking between the device 10 and the container 14. Further, it should be noted that by forming a secure fit which minimizes air flow into the nozzle 12, the device 10 provides a closure which prevents hardening of material adjacent to an opening in the end of the nozzle 12.

As may be seen in FIG. 3, the inner sleeve 24 is supported in spaced relation from the cylindrical side wall by a plurality of ribs 36 extending radially between the side wall 20 and the inner sleeve 24 along the length of the sleeve. The ribs 36 increase the rigidity of both the side wall 20 and the sleeve 24 while permitting the cap body 16 to be formed as a light member formed of a minimal amount of material.

In addition, the cylindrical side wall 20 is formed with a plurality of radially outwardly extending ribs 38 which extend parallel to the longitudinal axis 22. The ribs 38 facilitate gripping of the cap body 16 when the device 10 is used as an applicator to spread caulking material with the spreader blade 18.

As seen in FIGS. 1-4, the spreader blade 18 extends from the second end 32 of the cap body 16 and includes a first side 40 defining a central blade axis 42 extending substantially parallel to the longitudinal axis 22. The spreader blade 18 further includes a second side 42 having a central longitudinal portion 44 tapering toward the first side 40 such that the thickness of the blade 18 decreases in a longitudinal direction away from the second end 32 of the cap body 16. The junction between the first side 40 and the second side 42 defines a thin flexible feathered edge 46.

The spreader blade 18 further includes laterally extending wing portions 48, 50 located on either side of the central longitudinal portion 44. The laterally extending wing portions 48, 50 define a concave spreader surface facing away from the longitudinal axis 22, and the wing portions 48, 50 converge to an apex at the thin flexible feathered edge 46. Thus, the spreader blade 18 defines a channel for permitting passage of a predetermined amount of material past the end 46 of the spreader blade 18 and the end 46 flexes performing a wiping action to form a uniform bead of material.

Finally, it should be noted that the cap body 16 may be provided with a substantially planar face 52 defining a plane wherein the cap body 16 is located on one side of the plane and the spreader blade 18 is substantially located on the opposing side of the plane such that the cap body 16 forms a handle which is adapted to be held in spaced relation to a surface contacted by the spreader blade 18.

It should also be noted that the device 10 is preferably dimensioned such that it does not extend radially outwardly beyond the diameter of the container 14 and such that the edge 46 of the spreader blade 18 is maintained out of contact with the container 14 when the inner sleeve 24 is in frictional engagement with the nozzle 12.

Further, the above-described device is designed such that the blade faces downwardly toward the container whereby the blade will be protected from scuffing or other accidental damage during shipping.

Figure 6:
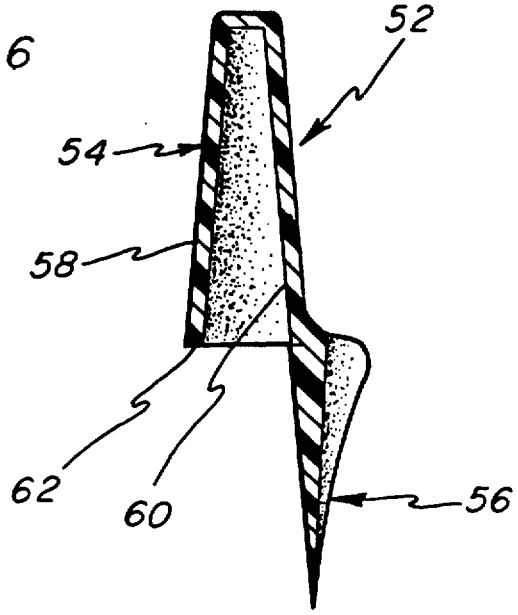
FIG. 6 is a cross-sectional side elevational view similar to FIG. 2 illustrating a second embodiment of the invention.

Referring to FIG. 6, a cap and applicator device 52 of a second embodiment of the present invention is shown and includes a main cap body 54 and a spreader blade 56. The main cap body 54 is formed with a single wall defined by an outer surface 58 and an inner surface 60. The inner surface 60 is adapted to frictionally engage a caulking cartridge nozzle whereby the cap and applicator device 52 is held in position on the cartridge. The spreader blade 56 is formed integrally with the main cap body 54 and extends from a second end 62 thereof whereby the main cap body 54 may be used as a handle while spreading a caulking bead with the spreader blade 56.

Figure 7:
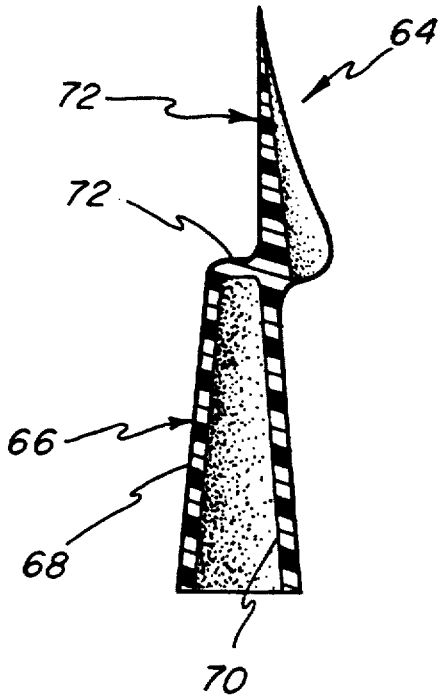
FIG. 7 is a cross-sectional side elevational view similar to FIG. 2 illustrating a third embodiment of the invention.

Referring to FIG. 7, a cap and applicator device 64 of a third embodiment of the present invention is shown and includes a main cap body 66 having a single wall construction as in the previous embodiment defined by an outer wall 68 and an inner wall 70. In this embodiment, a spreader blade 72 is provided formed integrally with the main cap body 66 and extending from a closed first end 74 thereof.

In each of the embodiments shown in FIGS. 6 and 7 it should be noted that the respective spreader blades 56 and 72 are configured substantially the same as the spreader blade 18 of the first embodiment. In addition, it should be noted that the construction of the second and third embodiments provide a low cost variation for the present invention in that only a single wall structure is provided for the main cap body, and that this variation also provides for a thinner handle for holding the spreader blade. Further, it should be noted that with each of the embodiments, the inner surface for frictionally engaging the caulking cartridge nozzle may be formed with a smooth surface or any number of friction enhancing protrusions such as beads or threads.

From the above description, it should be apparent that the present device provides a combined cap and applicator tool for resealing a cartridge. Thus, the present device minimizes waste by ensuring that the material within a partially used container of caulking is properly sealed.

An additional benefit of the present device results from the spreader blade minimizing the need to contact the bead, such as by using a finger to smooth the bead out, whereby a do-it-yourselfer will be able to form a uniform caulking bead having a professional appearance.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. A combination cap and applicator device comprising:

a tubular cap body including a cylindrical side wall and having opposing first and second ends, said cap body defining a cap body longitudinal axis, means interior of said cap body for engaging a container nozzle, a spreader blade formed integrally with said cylindrical side wall of said cap body and extending from said second end of said cap body for spreading a material dispensed through the container nozzle, said spreader blade including opposing first and second sides, said spreader blade defining a central blade axis parallel to said cap body longitudinal axis and further including a central longitudinal portion and a pair of wing portions extending laterally outwardly from said central longitudinal portion on said second side, and wherein said cap body is located on a laterally opposite side of said central blade axis from said pair of wing portions such that said cap body forms a handle adapted to be held in laterally spaced relation to a surface contacted by said wing portions.

2. The combination device of claim 1 wherein said wing portions define a spreader surface formed symmetrically about said central blade axis and defining a channel for permitting passage of a predetermined amount of material past an end of said spreader blade to form a uniform bead of material.

3. The combination device of claim 2 wherein said wing portions are located on opposing sides of said central blade axis, said wing portions converging toward each other to an apex distal from said cap body wherein said apex is formed as a relatively thin, flexible feathered edge for performing a wiping function to spread material.

4. The combination device of claim 1 wherein said central longitudinal portion tapers toward said first side in a longitudinal direction away from said second end of said cap body.

5. The combination device of claim 1 wherein said wing portions include outer edges which angle inwardly toward each other and toward said central blade axis in a longitudinal direction away from said second end of said cap body.

6. The combination device of claim 1 wherein said cap body includes a substantially planar surface extending parallel to said longitudinal axis and defining a plane, said cap body being substantially located on one side of said plane and said spreader blade being substantially located on an opposing side of said plane and longitudinally spaced from said cap body whereby said cap body forms a handle adapted to be held in spaced relation to a surface contacted by said spreader blade.

7. The combination device of claim 1 wherein said means for engaging a container nozzle includes a cylindrical inner sleeve extending from said first end toward said second end in spaced relation to said cap body.

8. The combination device of claim 7 wherein said cylindrical inner sleeve defines a smooth contact surface of decreasing circumference for forming an interference fit with the container nozzle.

9. The combination device of claim 8 including a bead formed on said contact surface and extending radially inwardly for engaging the container nozzle and defining a snap lock connection between said device and the container nozzle.

10. A combination cap and applicator device comprising:

a tubular cap body including a cylindrical side wall and having first and second ends, said cap body defining a cap body longitudinal axis, means interior of said cap body for engaging a container nozzle, a spreader blade formed integrally with said cylindrical side wall and extending from said second end of said cap body, said spreader blade including opposing first and second sides, said spreader blade defining a central blade axis parallel to said cap body longitudinal axis and further including a central longitudinal portion and pair of wing portions extending laterally outwardly from said central longitudinal portion of said second side and defining an apex point distal from said cap body wherein said apex point is formed as a flexible feathered edge for spreading a material dispensed through the container nozzle, and wherein said cap body is located on a laterally opposite side of said central blade axis from said pair of wing portions such that said cap body forms a handle adapted to be held in laterally spaced relation to a surface contacted by said wing portions.

11. The combination device of claim 10 wherein said cap body is longitudinally spaced from said spreader blade.

12. The combination device of claim 10 wherein said wing portions define a channel in said second side of said spreader blade.

13. The combination device of claim 12 wherein said wing portions include outer edges which converge toward each other to said apex point distal from said cap body.

14. The combination device of claim 12 wherein said second side tapers toward said first side in a direction toward said apex point to form said feathered edge.

15. A combination cap and applicator device for capping a container of air-curable material and for spreading material dispensed from the container, the device comprising:

a main cap body having a cylindrical side wall defining a cap body longitudinal axis, an end wall forming a closure for a first end of said main cap body and an open second end located opposite from said first end, a cylindrical inner sleeve extending from said end wall in spaced relation to and substantially concentric with said cylindrical side wall, said inner sleeve being tapered and being adapted to contact a dispensing nozzle of the container in an air-tight interference friction fit, a spreader blade extending from said second end and defining a central blade axis substantially parallel to said cap body longitudinal axis, said spreader blade including opposing first and second sides, said spreader blade further including a central longitudinal portion and a concave spreader surface defined by laterally extending wing portions extending laterally outwardly from said central longitudinal portion on said second side and facing away from said cap body longitudinal axis, said spreader blade decreasing in width and thickness in a direction extending away from said main cap body to form a flexible feathered edge, and a plurality of ribs extending radially from said cylindrical side wall parallel to said cap body longitudinal axis to thereby form a grip surface for holding said main cap body, and wherein said main cap body is located on a laterally opposite side of said central blade axis from said pair of wing portions such that said main cap body forms a handle adapted to be held in laterally spaced relation to a surface contacted by said wing portions.

16. The combination device of claim 1 wherein said cap body includes an opening in said second end for receiving the container nozzle.

17. The combination device of claim 10 wherein said cap body includes an opening in said second end for receiving the container nozzle.

* * * * *

UNITED STATES PATENT AND TRADEMARK OFFICE

CERTIFICATE OF CORRECTION

PATENT NO. : 5,301,843

DATED : April 12, 1994

INVENTOR(S) : David E. Groene and Earl E. Hoyt

It is certified that error appears in the above-identified patent and that said Letters Patent is hereby corrected as shown below:

Column 5, claim 10, line 59, "of" should be --on--.

Signed and Sealed this

Sixteenth Day of August, 1994

*Attest:*

*Attesting Officer*

BRUCE LEHMAN

*Commissioner of Patents and Trademarks*